US005876311A

United States Patent [19]

Coates et al.

[11] Patent Number: 5,876,311

[45] **Date of Patent: *Mar. 2, 1999**

[54] SIT AND BOUNCE EXERCISE DEVICE

[75] Inventors: Harold E. Coates; Judith I. Coates, both of North Hollywood; Michael C. Ayers, Oxnard; Bruce W. Farber, Oak View, all of Calif.

[73] Assignee: Allison Enterprise, Inc., Ventura, Calif.

[ * ] Notice: The term of this patent shall not extend beyond the expiration date of Pat. No. 5,704,882.

[21] Appl. No.: 969,473

[22] Filed: Nov. 13, 1997

Related U.S. Application Data

[63] Continuation-in-part of Ser. No. 691,968, Aug. 2, 1996, Pat. No. 5,704,882.

[51] Int. Cl.[6] ..... A63G 9/00

[52] U.S. Cl. ..... 482/77; 397/274

[58] Field of Search ..... 297/274, 273, 297/277, 5, 6, 281; 128/376, 377; 482/121, 27, 77, 78, 68, 69

[56] References Cited

U.S. PATENT DOCUMENTS

| | | | |
|---|---|---|---|
| 342,855 | 6/1886 | Abbey et al. | 297/281 |
| 743,546 | 11/1903 | Nix | 297/273 |
| 1,428,039 | 9/1922 | Kratz | 297/273 |
| 1,470,403 | 10/1923 | Thalken | 482/77 |
| 1,477,110 | 12/1923 | Cross | 297/278 |
| 1,527,451 | 2/1925 | Thalken | 482/77 |
| 2,365,003 | 12/1944 | Reinholz | 297/DIG. 11 |
| 2,697,477 | 12/1954 | Welsh . | |
| 2,723,855 | 11/1955 | McKee | 482/77 |
| 2,855,023 | 10/1958 | McKeel et al. | 297/274 |
| 2,860,689 | 11/1958 | Baker . | |
| 3,119,626 | 1/1964 | Strader | 482/77 |
| 3,233,895 | 2/1966 | Grelle | 482/27 |
| 3,369,786 | 2/1968 | Schloemer | 297/410 |
| 3,765,674 | 10/1973 | Siler | 297/273 X |
| 4,199,036 | 4/1980 | Wereb | 180/6.5 |
| 4,948,120 | 8/1990 | Krueger et al. | 297/274 |
| 5,399,139 | 3/1995 | Malynowsky | 482/121 |
| 5,690,383 | 11/1997 | Meeker | 247/274 |

FOREIGN PATENT DOCUMENTS

| | | | |
|---|---|---|---|
| 131731 | 11/1947 | Australia | 297/281 |

*Primary Examiner*—Jerome Donelly
*Attorney, Agent, or Firm*—Kelly Bauersfeld; Lowry & Kelley, LLP

[57] ABSTRACT

A rebound-type exercise device is provided which allows an individual to perform a sit and bounce exercises that, among other things, stimulate the lymphatic circulation. The exercise device includes a support frame which supports a seat assembly by means of four springs. The support frame includes a pair of laterally spaced apart side support frames which are interconnected by a head tube. Each side support frame includes a generally horizontal ground-engaging base tube, a rearwardly disposed, generally vertical rear support tube extending upwardly from the base tube, and a generally L-shaped arm which interconnects a front portion of the base tube with the upper end of the rear support tube. The exercise device of the present invention may be advantageously utilized in an exercise methodology intended to stimulate lymphatic circulation, wherein an individual seated within the support frame on the seat assembly continuously moves upwardly and downwardly in vertical harmonic motion through a range of two to eight inches. Such bouncing-type motion utilizing the exercise device of the present invention allows an individual, in a seated position, to become more fit by improving his or her endurance, strength/toning and lymphatic circulation in a safe and secure manner.

18 Claims, 3 Drawing Sheets

20
32
34
36
38
26

10
12
14
16a
16b
16c
16d
18
22
24
26
28
30
32
40
42
44
54
55
56
58
60
62
64

SIT AND BOUNCE EXERCISE DEVICE

RELATED APPLICATION

This is a continuation-in-part of U.S. patent application Ser. No. 08/691,968, filed Aug. 2, 1996, entitled SIT AND BOUNCE EXERCISE DEVICE now U.S. Pat. No. 5,704,882.

BACKGROUND OF THE INVENTION

This invention relates generally to rebound-type exercise equipment. More specifically, the present invention relates to an exercise chair with which one may perform sit and bounce-type exercises, upper and lower body muscle toning and strengthening, and lymphatic circulation stimulation.

Regular, daily exercise is necessary for a healthy lifestyle. Regular exercise has many beneficial effects, including stress reduction, stimulation of blood flow, the building of muscle strength, and in some cases the stimulation of the lymphatic system.

Three of the best selling drugs in the United States are used to treat stress-related illnesses. Eighty to ninety percent of all visits to health care professionals are a result of stress-related illnesses and issues, and seventy percent of all accidents are stress related. Constant stress has been linked to many serious diseases and entire centers and clinics for stress reduction and stress management are becoming common in our busy world. Reducing stress can relieve pain in muscles and joints and improve mental stability. Regular exercise is a highly desirable means for managing stress.

The lymphatic system is a system of vessels which closely parallels the blood vascular system. The lymphatic system helps maintain the proper fluid balance in the tissues and the blood by returning the blood protein and tissue fluid leaked from the blood vascular system to the blood. As a way to provide cells with nutrients, blood proteins seep out of the capillaries of the blood vascular system and into the interspacial spaces between the cells. Once the blood proteins diffuse from the capillaries of the blood vascular system into the tissue, the blood proteins are unable to be reabsorbed back into the circulatory system through the capillaries. The lymphatic system provides a method of removing the blood proteins from the spaces between the cells and transporting the blood proteins back into the circulatory system. The capillaries of the lymphatic system absorb the blood proteins from around the cells and into the lymphatic system. The blood proteins are removed through the vessels of the lymphatic system wherein the blood proteins are returned to the blood vascular system through the blood venous system.

Unlike the blood vascular system which is controlled by the heart, the lymphatic system has no separate means to pump the lymph through the lymphatic system to the blood venous system. The lymph movement depends primarily on external forces such as muscular contraction, respiratory movement and gravity. Thus, to move the lymph, especially upward through the legs, the lymphatic system relies on a series of one way valves and compression of the valved lymphatic trunks by the surrounding leg muscles. Therefore, in order to keep the lymphatic fluid moving through the lymphatic system and thus remove blood proteins from around tissue cells, the muscles in a particular body area, such as the legs, must be kept active.

Normally, the lymph fluid circulates completely through the body approximately two times every twenty-four hours. The use of rebound-type exercise equipment can speed up the flow of the lymph fluid, increasing the body's ability to eliminate toxins and provide needed nutrients to the body's cells. Studies have shown that exercises performed with rebound-type equipment increase oxygen supply to the body, stimulate blood flow and improve circulation. Examples of rebound-type exercises include jumping up and down on a diving board or on a trampoline. It is believed that rebound-typeexercises advantageously stimulate the lymphatic system because at the top of the jump the body is in an essentially weightless condition. The lymphatic valves open at the top of the bounce, thereby permitting a greater flow of lymph fluids.

Although the advantages of rebound-type exercises are well-known, prior exercise devices are usable only by the most fit of possible beneficiaries. This fact is evident when one realizes that only relatively fit individuals are able to jump up and down on a trampoline or a diving board for a sustained period of time.

The Surgeon General, in the 1996 report on Physical Activity and Health, presents guidelines for "thirty minutes or more of moderate-intensity physical activity on all, or most, days of the week." However, the report also points out that the most common health problems that have been associated with physical activity are musculoskeletal injuries, which can occur with excessive amounts of activity or with suddenly beginning an activity for which the body is not conditioned. Both endurance and resistance exercise is recommended at moderate levels. The universally ideal form of exercise would incorporate rebound, endurance and resistance-type exercise with easily controlled activity levels by the user.

Accordingly, there is a need for rebound-type exercise equipment which may be utilized by a far greater number of people than prior devices. Preferably a new piece of rebound-type exercise equipment would permit exercising while one is seated, and yet obtain all of the benefits associated with rebound-type exercise. Further, such an exercise device must be of simple construction, and easy to manufacture of readily available materials. Additionally, a novel exercise process is needed for stimulating lymphatic circulation. Such an exercise process must be a practical alternative to standard types of exercising for a vast majority of the population. Moreover, such a device and exercise process is needed which allows a user to incorporate rebound, endurance and resistance-type exercises, and for which the activity level is easily controlled by the user. The present invention fulfills these needs and provided other related advantages.

SUMMARY OF THE INVENTION

The present invention resides in a sit and bounce exercise device which advantageously permits an individual to enjoy the benefits of rebound-type exercising without being required to stand, and related exercise process for stimulating the lymphatic system of an individual. The exercise device comprises, generally, a support frame including a pair of laterally spaced apart side support frames interconnected by a head tube, first spring means supported by the head tube, second spring means disposed forwardly of the first spring means and supported by at least one of the side support frames, and a seat assembly supported within the support frame by the first and second spring means.

In one preferred form of the invention, the head tube comprises an inverted U-shaped tube having ends thereof which are insertable into respective upper ends of the side support frames. Each side support frame comprises a generally horizontal ground-engaging base tube, a rearwardly disposed, generally vertical rear support tube extending upwardly from the base tube and having an open upper end, and a generally L-shaped arm which interconnects a front portion of the base tube with the upper end of the rear support tube. The ends of the head tube are inserted into the open upper ends of the rear support tubes.

Means are provided for securely attaching the head tube to the rear support tubes. The attaching means comprises alignable apertures through each of the head and rear support tubes, a threaded nut interiorly fixed within each end of the head tube in alignment with its aperture, and a bolt insertable through the aligned apertures of the head and rear support tubes.

A padded head piece is attached to a central, generally horizontal portion of the head tube.

A generally U-shaped stabilizer has ends that are insertable into respective open rear ends of the base tubes. Means are provided for securely attaching the stabilizer to the base tubes. The attaching means comprises alignable apertures through each of the stabilizer and the base tubes, a threaded nut interiorly fixed within each base tube in alignment with its aperture, and a bolt insertable through the aligned apertures of the stabilizer and the base tubes.

The first spring means comprises a pair of laterally spaced apart rear springs supported by and hanging downwardly from the head tube. The second spring means comprises a pair of laterally spaced apart front springs supported by and hanging downwardly from the L-shaped arms. Gussets are fixed to the head tube and to the arms, to which the respective springs are attached. A safety sleeve generally envelopes each spring individually.

The seat assembly includes a bottom support, a pair of upwardly extending front straps connected at their upper ends to the front springs, and a pair of upwardly extending rear straps connected at their upper ends to the rear springs. A back support extends between the rear straps.

In another preferred form of the invention, the first spring means comprises a pair of laterally spaced apart rear compression springs which are supported by the head tube. The second spring means comprises a pair of laterally spaced apart front compression springs which are supported by the L-shaped arms.

Use of the sit and bounce exercise device of the present invention helps to stimulate the flow of lymphatic fluids through the body, thus assisting the body in removing toxins, strengthening the immune system, and building strong, healthy cells. Blood circulation is also improved as well as muscular strength.

The invention further comprises an exercise process for stimulating the lymphatic system of an individual. The steps of the exercise process include providing a sit and bounce exercise device as described above, seating the individual within the support frame upon the seat assembly, and reciprocally moving the seat assembly upwardly and downwardly in a continuous vertical harmonic motion through a capable range of two to eight inches while the individual remains seated on the seat assembly. To obtain the beneficial effects of the exercise process, the individual need not cycle through the full capable range, but it is important that the individual be capable of moving through the designed range. The vertical harmonic motion may be obtained by pushing upwardly with the individual's legs to create the reciprocal movement of the seat assembly. Alternatively and/or concurrently, the individual may be able to create the reciprocal movement of the seat assembly by pushing or pulling upwardly or downwardly with the individual's upper body on the support frame.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
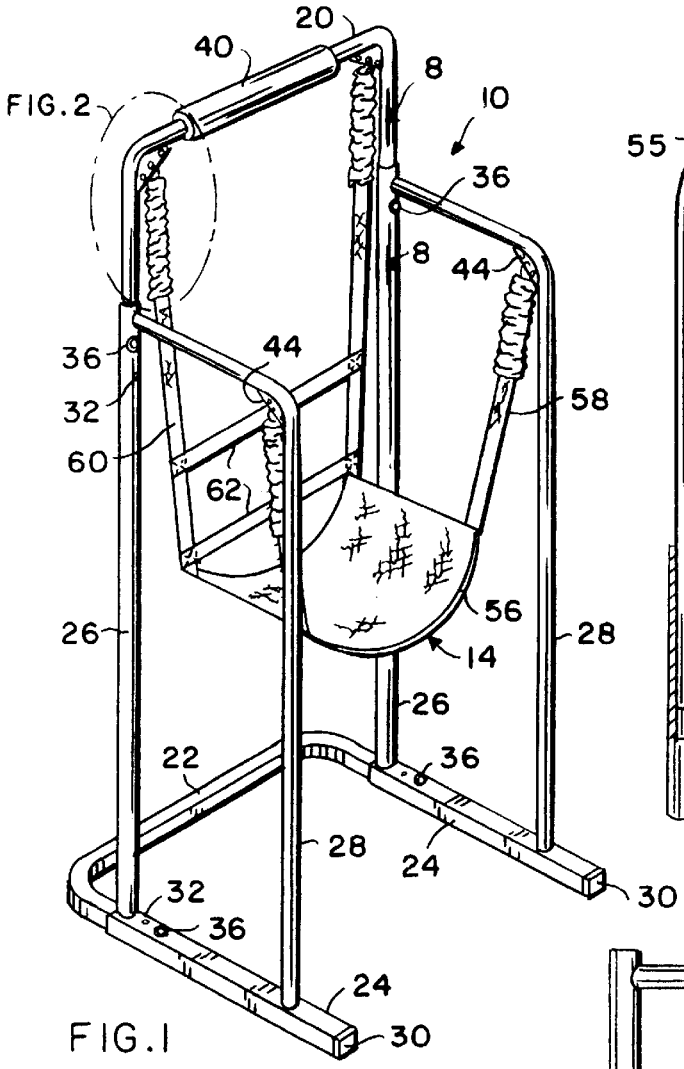
FIG. 1 is a perspective view of a sit and bounce exercise device embodying the invention.
Figure 2:
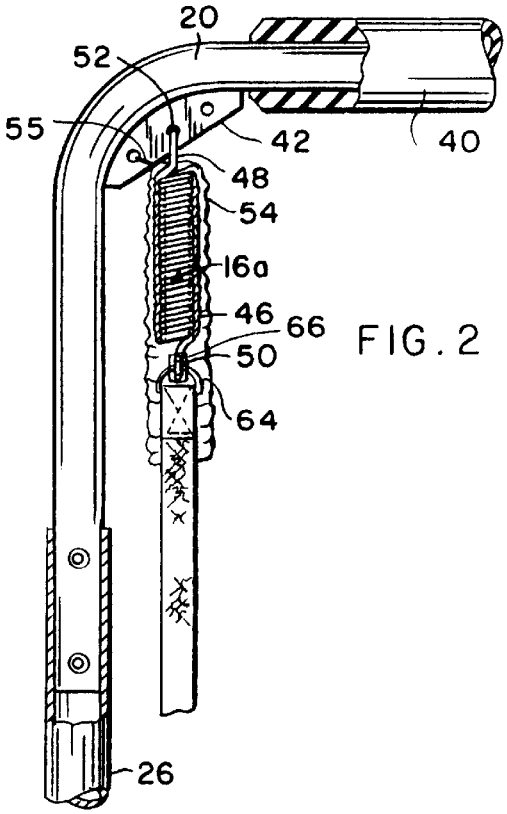
FIG. 2 is an enlarged, fragmented and partially sectional view of the area indicated by the number 2 in FIG. 1, illustrating the attachment of a head tube to a side support frame and details of a spring attached to the head tube which depending therefrom to support a rear strap of a seat assembly.
Figure 4:
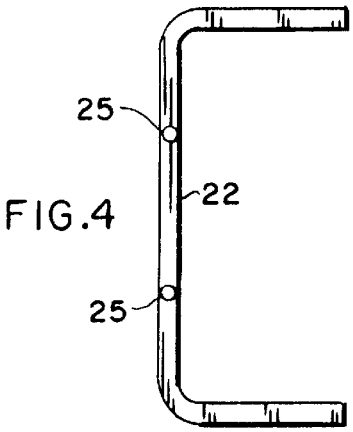
FIG. 4 is top plan view of a stabilizer forming a portion of the support frame.
Figure 3:
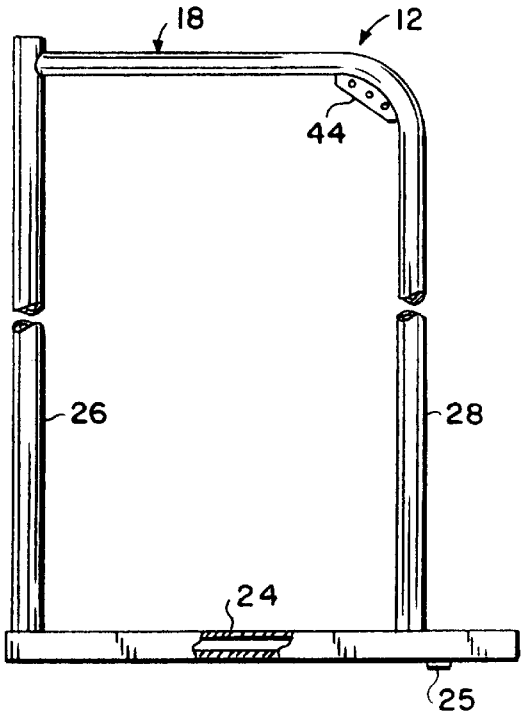
FIG. 3 is a side elevational view of a side support frame shown in FIG. 1.
Figures 5, 6, 7, 8:
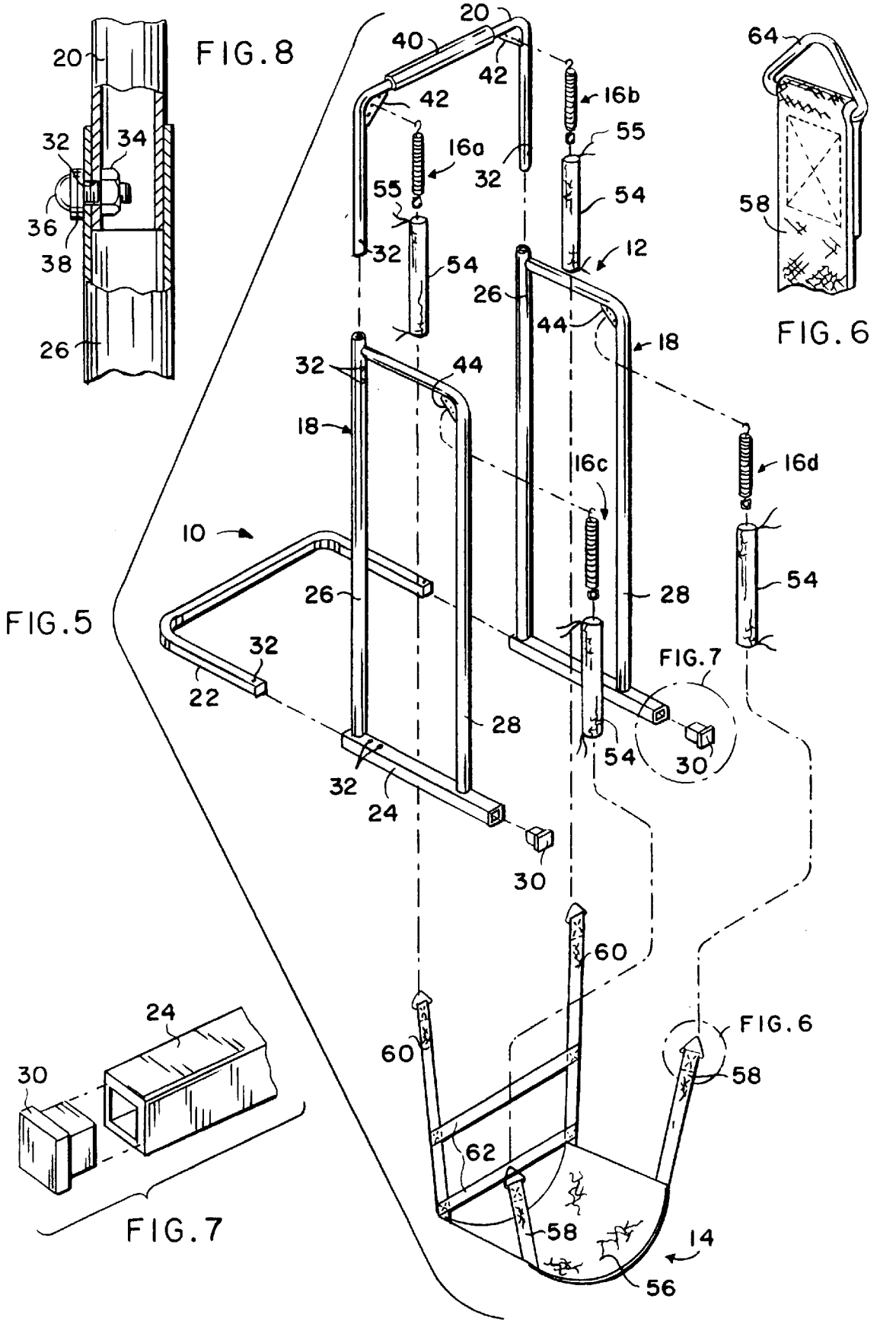
FIG. 5 is an exploded perspective view of the sit and bounce exercise device of FIG. 1.
FIG. 6 is an enlarged fragmented perspective view of the upper end of a front strap of the seat assembly, taken generally of the area indicated by the number 6 in FIG. 5.
FIG. 7 is an enlarged, fragmented perspective view of a front end of a base tube, taken generally of the area indicated by the reference number 7 in FIG. 5.
FIG. 8 is an enlarged, fragmented and partially sectional view taken generally along the line 8—8 of FIG. 1, illustrating attachment of the head tube to the side support frame.

As shown in the drawings for purposes of illustration, the present invention is concerned with a sit and bounce exercise device, generally designated in the accompanying drawings by the reference numbers 10 and 10'. The present invention is further concerned with an exercise method for stimulating lymphatic circulation that advantageously utilizes the devices 10 and 10'.

With reference to FIGS. 1–8, the exercise device 10 comprises, generally, a support frame 12 and a seat assembly 14 which hangs from a plurality of springs 16*d* attached to the support frame. The support frame 12 is comprised of a pair of laterally spaced apart side support frames 18 which are interconnected at an upper end by means of an inverted U-shaped head tube 20, and at a lower end by means of a U-shaped stabilizer 22. Each side support frame 18 includes a generally horizontal base tube 24 which lies adjacent to a ground surface. Preferably, non-skid feet 25 are provided on an under-surface of the base tubes 24 and the stabilizer 22. A rear support tube 26 extends vertically upwardly from a rear end of the base tube 24 and the stabilizer 22. The rear support tube 26 has an open upper end configured to receive a corresponding end of the head tube 20 therein. An L-shaped arm 28 extends from a forward end of the base tube 24 vertically upwardly and then rearwardly to the adjacent rear support tube 26. The arms 28 interconnect the base tube 24 and the rear support tube 26 of the respective side support frames 18.

The front ends of the base tubes 24 are fitted with plugs 30. The free ends of the stabilizer 22 are fitted within the open rear ends of base tubes 24. Thus, the head tube 20 and the stabilizer 22 serve to interconnect the upper and lower ends of the laterally spaced apart side support frames 18.

Means are provided for securely attaching the head tube 20 to the rear support tubes 26 and the stabilizer 22 to the base tubes 24. In this regard, with reference to FIG. 8, the adjoining tubes are provided alignable apertures 32. The inner tube (either a free end of the stabilizer 22 or the head tube 20) has a threaded nut 34 welded in place on an interior surface adjacent to the aperture 32. Thus, when the apertures 32 are aligned with one another, a bolt 36 carrying a lock washer 38 may be inserted through the aligned apertures 32 to be threadably received by the nut 34.

The upper central portion of the head tube 20 is provided with a padded head piece 40. Secured within the bends of the head tube 20 are gussets 42 which serve to strengthen the head tube 20 and also provide apertures for hanging the springs 16*a* and 16*b* therefrom. Gussets 44 are also provided in the bend section of each arm 28 for a similar purpose.

Four springs 16*a–d* are provided the exercise device 10. A pair of laterally spaced apart rear springs 16*a* and 16*b* are supported from the head tube 20 gussets 42. A pair of laterally spaced apart front springs 16*c* and 16*d* are supported by and hang downwardly from the gussets 44 of the side support frames 18. Each spring 16*a*–16*d* includes a central coil spring portion 46, an upper hook 48 and a lower hook 50. The upper hooks 48 are all received within an aperture 52 of the respective gussets 42 and 44. A safety sleeve 54 generally envelopes each spring 16*a*–16*d*, wherein each sleeve 54 includes upper and lower ties 55.

The seat assembly 14 includes a bottom support 56, a pair of upwardly extending front straps 58, and a pair of upwardly extending rear straps 60. A pair of back support straps 62 extend between the rear straps 60. The upper ends of the front and rear straps 58 and 60 are sewn so as to secure therein a D-ring 64. Each D-ring 64 is placed over a respective lower hook 50 of a respective spring 16*a*–16*d* to position the seat assembly 14 within the support frame 12. The lower hooks 50 are each provided a segment of capture tubing 66 to secure the respective D-ring 64 to the hook.

The seat assembly 14 may be hung from any set of the three apertures provided in each of the gussets 42 and 44. In general, a taller or heavier person will use the uppermost apertures, while a shorter or lighter weight person will use the lower apertures. The center apertures 52 are typically used if more than one person will utilize the exercise device 10. In particular, after the upper hooks 48 are placed within the respective apertures 52 of the gussets 42 and 44, the ties 55 for the respective safety sleeves 54 are secured to an adjacent aperture of the gussets 42 and 44 to anchor the safety sleeves properly in place over the respective springs 16*a*–16*d*.

Figure 9:
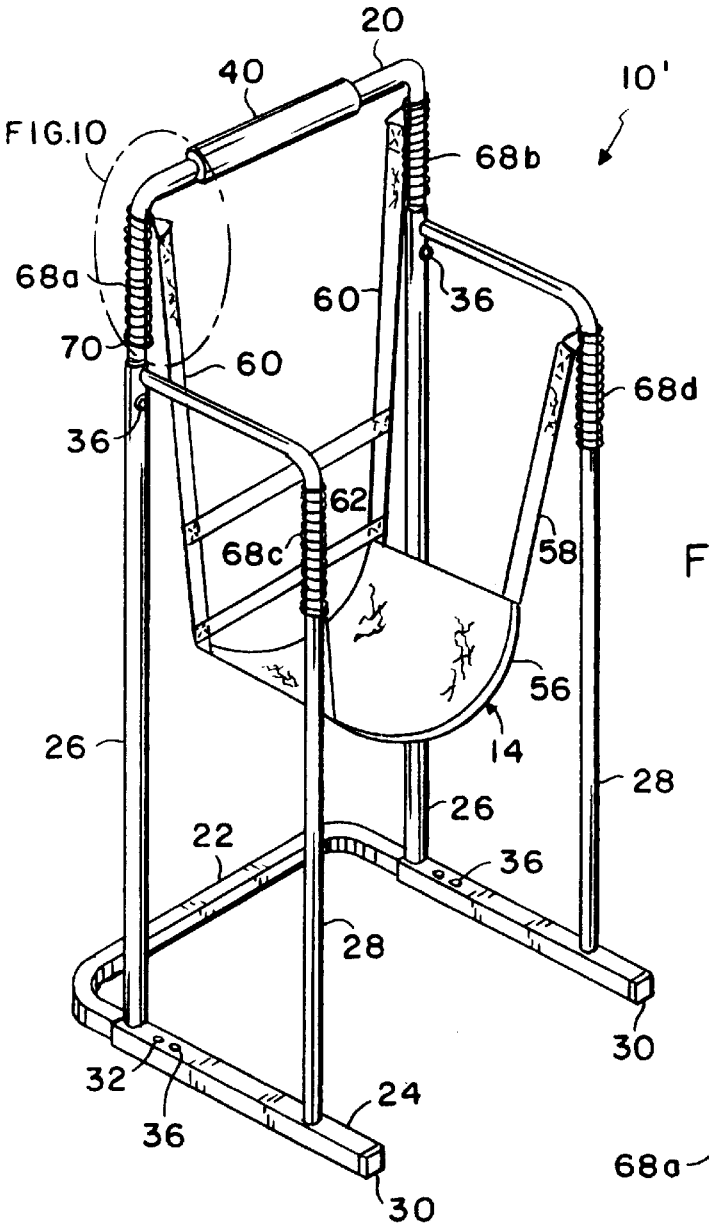
FIG. 9 is a perspective view similar to that illustrated in FIG. 1, illustrating an alternative embodiment of a sit and bounce exercise device embodying the invention.
Figure 10:
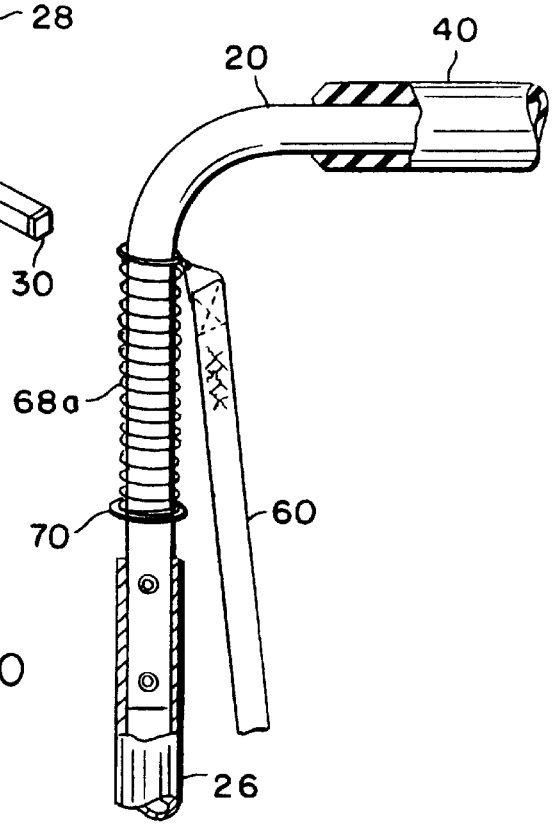
FIG. 10 is an enlarged, fragmented and partially sectional view of the area indicated by the number 10 in FIG. 9, illustrating an alternative method of springably supporting the rear strap of a seat assembly from the head tube.

With reference now to FIGS. 9 and 10 another embodiment of the exercise device 10' is illustrated. As shown, the exercise device 10' is quite similar in construction and use to the exercise device 10 of FIGS. 1–8, and comprises, generally, a support frame 12 and a seat assembly 14 which hangs from a plurality of compression springs 68*a*–68*d* attached to the support frame. Indeed, with the exception of the attachment of the seat assembly 14 to the compression springs 68, the construction of the exercise device 10' is virtually identical to the device 10, and thus the components described above retain their same reference numbers in FIGS. 9 and 10.

The embodiment of FIGS. 9 and 10 illustrates an alternative manner of suspending the seat assembly 14 from the frame 12. The rear compression springs 68*a* and 68*b* rest upon respective spring supports 70 that are affixed to the head tube 20 in proximity to the ends thereof. The spring supports 70 may comprise a flange-like washer welded in place upon which the compression springs 68*a* and 68*b* rest. The upper ends of the rear straps 60 are then attached, in any suitable manner, to the upper ends of the respective compression springs 68*a* and 68*b*. Similarly, the compression springs 68*c* and 68*d* rest upon corresponding spring supports 70 fixed to a portion of the respective arms 28 in the same manner as described above. The front straps 58 of the seat assembly 14 are then affixed to an upper end of the respective springs 68*c* and 68*d* to suspend the seat assembly 14 from the support frame 12.

In use, an individual may be seated on the seat assembly 14 and gently bounce vertically while seated to obtain the benefits of rebound-type exercising. The particular configuration of the support frame 12 relative to the seat assembly 14 provides a comfortable exercise environment, and the springs 16*a*–16*d* provide ample support for the total weight of a normal individual seated on the seat assembly. As noted above, benefits of such rebound-type exercising include stress reduction, stimulation of the lymphatic system, stimulation of blood flow and improved circulation, and building strength. The sit and bounce exercise device 10 of the present invention is particularly useful for those individuals who have not been able to exercise on standard equipment. Utilizing the springs 16*a*–16*d* for assistance in pulling up one's body weight, an individual can gently and methodically build muscular strength.

More specifically, an individual desiring to utilize the exercise devices 10 or 10' would be seated upon the bottom support 56 of the seat assembly 14 with his or her feet lightly contacting a ground surface. The individual would then begin a bouncing type movement vertically upwardly and downwardly on the seat assembly 14 within the support frame 12. Ideally, the individual would attain a reciprocating continuous vertical harmonic motion through a range of two to eight inches in order to stimulate the lymphatic system. This may be accomplished by pushing off the ground surface with one's feet or by applying upward and/or downward forces to the body by grasping a portion of the support frame 12 with the upper body and pulling or pushing thereon. Both the tension springs 16*a*–16*d* and the compression springs 68*a*–68*d* provide passive elastic means that allow the seat assembly to move through the desired range of vertical reciprocating motion. Of course other types of passive elastic means, such as elastic tubing and the like, could be utilized in place of the springs.

The vertical harmonic motion attainable utilizing the exercise devices 10 and 10' exercises the entire body and stimulates lymphatic circulation throughout the upper legs, trunk and head. Further, exercise utilizing the devices 10 and 10' advantageously improves the user's endurance and strength/toning as well as the lymphatic circulation, all without significantly compressing hip, knee and ankle joints. Moreover, the exercise device 10 and 10' of the present invention can be worked at both low and high levels of exertion without requiring the individual utilizing the device to have good balance, because the individual is secure in a seated position within a rigid support frame 12.

Although two embodiments of the invention have been described in detail for purposes of illustration, various modifications may be made without departing from the spirit and scope of the invention. Accordingly, the invention is not to be limited, except as by the appended claims.

We claim:

1. An exercise process for stimulating the lymphatic system of an individual, comprising the steps of:

providing a sit and bounce exercise device including a support frame and a seat assembly supported within the support frame by spring means;

seating the individual within the support frame upon the seat assembly; and reciprocally moving the seat assembly upwardly and downwardly in a continuous vertical harmonic motion through a capable range of two to eight inches while the individual remains seated upon the seat assembly;

wherein the support frame includes a pair of laterally spaced apart side support frames interconnected by a head tube, the spring means comprises first spring means extending between the head tube and the seat assembly, and second spring means disposed forwardly of the first spring means and extending between at least one of the side support frames and the seat assembly, and wherein the seat assembly is supported within the support frame by the front and rear spring means, and wherein each side support frame comprises a generally horizontally ground engaging base tube, as rearwardly disposed, generally vertical rear support tube extending upwardly from the base tube and having an open upper end, and a generally L-shaped arm which interconnects a front portion of the base tube with the upper end of the rear support tube, wherein ends of the head tube are inserted into the open upper ends of the rear support tubes.

2. The process of claim 1, including the step of pushing upwardly with the individual's legs to create the reciprocal movement of the seat assembly.

3. The process of claim 1, including the step of pushing or pulling upwardly or downwardly with the individual's upper body to create the reciprocal movement of the seat assembly.

4. The process of claim 1, wherein the first spring means comprises a pair of laterally spaced apart rear springs supported by and hanging downwardly from the head tube, the second spring means comprises a pair of laterally spaced apart front springs supported by and hanging downwardly from the L-shaped arms, the seat assembly includes a bottom support, a pair of upwardly extending front straps connected at their upper ends to the front springs, and a pair of upwardly extending rear straps connected at their upper ends to the rear springs, and a safety sleeve generally enveloping each spring.

5. The process of claim 1, wherein the first spring means comprises a pair of laterally spaced apart rear compression springs supported by the head tube, the second spring means comprises a pair of laterally spaced apart front compression springs supported by the L-shaped arms.

6. An exercise process for stimulating the lymphatic system of an individual, comprising the steps of:

providing a sit and bounce exercise device including a pair of laterally spaced apart side support frames, an inverted U-shaped head tube having ends thereof insertable into respective upper ends of the side support frames, a pair of laterally spaced apart rear springs supported by the head tube, a pair of laterally spaced apart front springs supported by the side support frames, and a seat assembly including a bottom support, a pair of upwardly extending front straps connected at their upper ends to the front springs, and a pair of upwardly extending rear straps connected at their upper ends to the rear springs;

seating the individual within the support frame upon the seat assembly; and reciprocally moving the seat assembly upwardly and downwardly in a continuous vertical harmonic motion while the individual remains seated upon the seat assembly.

7. The process of claim 6, wherein the step of reciprocally moving the seat assembly upwardly and downwardly is accomplished through a capable range of two to eight inches.

8. The process of claim 6, wherein each side support frame comprises a generally horizontal ground-engaging base tube, a rearwardly disposed, generally vertical rear support tube extending upwardly from the base tube and having an open upper end, and a generally L-shaped arm which interconnects a front portion of the base tube with the upper end of the rear support tube, wherein the ends of the head tube are inserted into the open upper ends of the rear support tubes.

9. The process of claim 8, including means for securely attaching the head tube to the rear support tubes, the attaching means comprising alignable apertures through each of the head and rear support tubes, a threaded nut interiorly fixed within each end of the head tube in alignment with its aperture, and a bolt insertable through the aligned apertures of the head and rear support tubes, the bolt threadably receivable by the respective nut.

10. The process of claim 9, including a generally U-shaped stabilizer having ends thereof insertable into respective open rear ends of the base tubes, including means for securely attaching the stabilizer to the base tubes, the attaching means comprising alignable apertures through each of the stabilizer and the base tubes, a threaded nut interiorly fixed within each base tube in alignment with its aperture, and a bolt insertable through the aligned apertures of the stabilizer and the base tubes, the bolt threadably receivable by the respective nut.

11. The process of claim 6, including a padded head piece attached to a central, generally horizontal portion of the head tube.

12. The process of claim 6, including a safety sleeve generally enveloping each spring.

13. The process of claim 6, including the step of pushing upwardly with the individual's legs to create the reciprocal movement of the seat assembly.

14. The process of claim 6, including the step of pushing or pulling upwardly or downwardly with the individual's upper body to create the reciprocal movement of the seat assembly.

15. An exercise process for stimulating the lymphatic system of an individual, comprising the steps of:

providing a sit and bounce exercise device including a support frame including a pair of generally horizontal, ground-engaging base tubes, an inverted U-shaped rear support member extending vertically upwardly from and interconnecting rear portions of the base tubes, and a pair of laterally spaced apart, generally L-shaped arms which each interconnects a front portion of the respective base tube with an adjacent upper portion of the rear support member, rear spring means supported by the rear support member, front spring means supported by the L-shaped arms, and a seat assembly supported within the support frame by the front and rear spring means;

seating the individual within the support frame upon the seat assembly; and reciprocally moving the seat assembly upwardly and downwardly in a continuous vertical harmonic motion through a capable range of two to eight inches while the individual remains seated upon the seat assembly, by pushing upwardly with the individual's legs.

16. The process of claim 15, wherein the seat assembly includes a bottom support, a pair of upwardly extending front straps connected at their upper ends to the front spring means, and a pair of upwardly extending rear straps connected at their upper ends to the rear spring means.

17. The process of claim 16, wherein the rear spring means comprises a pair of laterally spaced apart rear springs supported by and hanging downwardly from the rear support member, and wherein the front spring means comprises a pair of laterally spaced apart front springs supported by and hanging downwardly from the L-shaped arms.

18. The process of claim 16, wherein the first spring means comprises a pair of laterally spaced apart rear compression springs supported by the head tube, the second spring means comprises a pair of laterally spaced apart front compression springs supported by the L-shaped arms.

* * * * *